US009803311B2

(12) United States Patent
Lee et al.

(10) Patent No.: US 9,803,311 B2
(45) Date of Patent: Oct. 31, 2017

(54) WASHING MACHINE

(75) Inventors: Junghwan Lee, Seoul (KR); On Kim, Seoul (KR); Nerry Son, Seoul (KR); Hoil Jeon, Seoul (KR); Yeji Um, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 330 days.

(21) Appl. No.: 14/241,183

(22) PCT Filed: Aug. 29, 2012

(86) PCT No.: PCT/KR2012/006897

§ 371 (c)(1),
(2), (4) Date: Feb. 26, 2014

(87) PCT Pub. No.: WO2013/032224

PCT Pub. Date: Mar. 7, 2013

(65) Prior Publication Data

US 2014/0190220 A1 Jul. 10, 2014

(30) Foreign Application Priority Data

Sep. 2, 2011 (KR) ..... 10-2011-0089117
Sep. 2, 2011 (KR) ..... 10-2011-0089118
Sep. 2, 2011 (KR) ..... 10-2011-0089119

(51) Int. Cl.
*D06F 39/02* (2006.01)

(52) U.S. Cl.
CPC ..... *D06F 39/026* (2013.01); *D06F 39/02* (2013.01); *D06F 39/022* (2013.01)

(58) Field of Classification Search
CPC ..... D06F 39/02; D06F 39/022; D06F 39/026
USPC ..... 68/12.18, 17 R
See application file for complete search history.

(56) References Cited

U.S. PATENT DOCUMENTS

2003/0145633 A1 8/2003 Merkle et al. ..... 68/17
2004/0168483 A1* 9/2004 Kim ..... D06F 39/02 68/17 R
2005/0229652 A1 10/2005 Kim et al. ..... 68/237
2010/0018258 A1* 1/2010 Cho ..... D06F 39/088 68/17 R

FOREIGN PATENT DOCUMENTS

CN 1465800 1/2004
CN 1465802 A 1/2004
CN 101177894 A 5/2008
CN 101680152 A 3/2010
(Continued)

OTHER PUBLICATIONS

European Search Report dated Apr. 14, 2015 issued in Application No. 12826787.9.

(Continued)

*Primary Examiner* — Michael Barr
*Assistant Examiner* — Levon J Shahinian
(74) *Attorney, Agent, or Firm* — KED & Associates, LLP

(57) ABSTRACT

The present invention relates to a washing machine including a cabinet (110) which forms an exterior appearance of the washing machine, a tub (120) provided to the cabinet (110), a drum (130) rotatably provided to the tub, and a detergent dispenser (200) positioned on an upper side of the cabinet (110), the detergent.

16 Claims, 11 Drawing Sheets

(56) References Cited

FOREIGN PATENT DOCUMENTS

| | | | |
|---|---|---|---|
| CN | 102137967 | A | 7/2011 |
| CN | 201896255 | U | 7/2011 |
| DE | 100 31 168 | | 1/2002 |
| EP | 1 764 437 | A1 | 3/2007 |
| EP | 2 325 376 | A1 | 5/2011 |
| FR | 2202182 | A | 5/1974 |
| KR | 10-2002-0057144 | A | 7/2002 |

OTHER PUBLICATIONS

International Search Report dated Mar. 4, 2013 issued in Application No. PCT/KR2012/006897.
Chinese Office Action dated May 10, 2016 issued in Application No. 201280045313.8 (with English Translation).

* cited by examiner

WASHING MACHINE

CROSS-REFERENCE TO RELATED PATENT APPLICATIONS

This application is a U.S. National Stage Application under 35 U.S.C. §371 of PCT Application No. PCT/KR2012/006897, filed Aug. 29, 2012, which claims priority to Korean Patent Application Nos. 10-2011-0089117, 10-2011-0089118, and 10-2011-0089119, each filed Sep. 2, 2011.

TECHNICAL FIELD

The present invention relates to washing machines, and more particularly, to a washing machine having a dispenser provided thereto for selective dispensing of powder detergent and liquid detergent in washing.

BACKGROUND ART

In general, a laundry machine includes a dryer for drying laundry, and the washing machine for washing the laundry. In general, of the laundry machine, the washing machine uses detergent and the like for washing, for which the washing machine is provided with a detergent dispenser for introduction of the detergent to the washing machine. Therefore, the detergent dispenser is an apparent configuration particularly for the washing machine.

A related art detergent dispenser will be described briefly with reference to the attached drawing.

FIG. 1 illustrates a perspective view of a related art washing machine and the related art detergent dispenser.

Referring to FIG. 1, the related art washing machine 10 is provided with a cabinet 11 which forms an exterior appearance of the washing machine 10, a tub (Not shown) in the cabinet for holding washing water, and a drum 13 rotatably provided in the tub for introduction of the laundry thereto. The washing machine is provided with a detergent dispenser 20 for introduction of detergent to improve a washing effect of the laundry being washed by the drum 13.

The detergent dispenser 20 is provided with, in general, a detergent introduction unit 22 in a form of a drawer a portion of which is to be drawn to a front of the washing machine 10 for introduction of the detergent to the detergent introduction unit 22 drawn thus, and placing the detergent introduction unit 22 in the detergent dispenser 20 for washing the laundry.

That is, the detergent dispenser 20 has the detergent introduction unit 22 for introduction of the detergent, and the detergent introduced to the detergent introduction unit 22 is supplied to the tub or the drum 13 which are spaces for washing together with the washing water.

In the meantime, as the detergent for washing, power detergent and liquid detergent are used, mostly. The powder detergent is not washed by, or dissolved in, the washing water adequately, but is hardened, frequently. That is, once the powder detergent is hardened after wetted without being dissolved, the powder detergent sticks to the detergent introduction unit 22 which is hard to remove. Therefore, if the powder detergent is used, it is required to pay attention to contamination of the detergent dispenser 20 with the powder detergent.

Along with this, currently a trend is increasing, in which, not only the powder detergent, but also the liquid detergent is used. In comparison to the powder detergent, since the liquid detergent is dissolved very well, the liquid detergent seldom contaminates the detergent dispenser 20.

However, the use of the liquid detergent or the powder detergent is dependent on user's tastes. Therefore, a necessity for developing a detergent dispenser 20 meeting such diversity of the detergent is on the rise.

Moreover, recently to overcome a simple concept of washing, not only the liquid detergent, but also fiber softener, is used widely for providing aroma and softness to the laundry. However, since the fiber softener is used in rinsing, it is required to prevent the washing water from mixing with the fiber softener at the time the washing water is being supplied to the detergent dispenser 20.

At the end, it is necessary to provide the detergent dispenser 20 which meets different user's requirements taking forms of the detergent (For an example, the powder detergent and the liquid detergent and so on) available and the fiber softener into account.

DISCLOSURE OF INVENTION

Technical Problem

To solve the problems, basically an object of the present invention is to provide a washing machine in which a detergent dispenser in the related art washing machine is improved for a user to use the detergent dispenser easily and conveniently.

In more detail, another object of the present invention is to provide a washing machine having a detergent dispenser which enables selective introduction of powder detergent or liquid detergent for washing.

Moreover, another object of the present invention is to provide a washing machine having a detergent dispenser which enables convenient cleaning of the detergent dispenser for maintenance when the detergent dispenser is used for a long time period.

Furthermore, another object of the present invention is to provide a washing machine having a detergent dispenser which enables to deal with user's change of requirements for kinds of the detergent and fiber softener and a user to use conveniently.

Solution to Problem

To achieve these objects and other advantages and in accordance with the purpose of the invention, as embodied and broadly described herein, a washing machine includes a cabinet which forms an exterior appearance of the washing machine, a tub provided to the cabinet, a drum rotatably provided to the tub, and detergent dispenser positioned on an upper side of the cabinet, the detergent dispenser having a powder detergent introduction portion for introducing powder detergent, and a liquid detergent portion which enables selective supply of the powder detergent and the liquid detergent by exposing/covering the powder detergent introduction portion.

Preferably, the detergent dispenser includes a dispenser housing secured to the an inside of the cabinet to be in communication with the tub, and a detergent introduction tray having the powder detergent introduction portion formed therein, the detergent introduction tray detachably seated on the dispenser housing.

In the meantime, preferably, the detergent introduction tray includes a cover at one side thereof for covering an upper side of the detergent introduction tray.

And, preferably, the dispenser housing has a detergent supply hole connected to the tub, and the dispenser housing and the powder detergent introduction portion are sloped downward to the detergent supply hole.

And, preferably, the powder detergent introduction portion include dissolving water supply means for supplying dissolving water to improve fluidity of the powder detergent.

In the meantime, preferably, the liquid detergent portion slidably moves to/from the powder detergent introduction portion to expose/cover the powder detergent introduction portion, selectively.

In this instance, the dispenser housing further includes a space portion formed therein for forming a space the liquid detergent portion can move thereto when the liquid detergent portion slidably moves from the powder detergent introduction portion.

And, preferably, the detergent dispenser includes one pair of grooves extended to both sides of an outside of the liquid detergent portion parallel to a moving direction of the liquid detergent portion, and one pair of rails extended to both sides of an inside of the powder detergent introduction portion and the space portion to seat the grooves thereon, respectively.

And, preferably, the liquid detergent portion has a container shape with one opened upper side having a valve provided to a bottom thereof for discharging the liquid detergent introduced thereto by siphon.

And, preferably, the liquid detergent portion has a bottom sloped downward to the valve.

And, preferably, the detergent introduction tray further includes a fiber softener introduction portion for introduction of fiber softener, and a supplementary detergent introduction portion for introduction of supplementary detergent.

And, preferably, the fiber softener introduction portion further includes a fiber softener tank detachably or slidably seated thereon.

And, preferably, the supplementary detergent introduction portion further includes a supplementary detergent tank detachably or slidably seated thereon.

Or, alternatively, it is preferable that the liquid detergent portion rotates with respect to the powder detergent introduction portion to expose/cover the powder detergent introduction portion, selectively.

In this instance, preferably, the washing machine further includes a rotatable frame rotatably provided to the detergent introduction tray for mounting and rotating the liquid detergent portion and exposing the powder detergent introduction portion, selectively.

And, preferably, the detergent introduction tray further includes a fiber softener introduction portion for introduction of the fiber softener, and the rotatable frame further includes a fiber softener tank for exposing the fiber softener introduction portion, selectively.

And, the detergent introduction tray further includes a supplementary detergent introduction portion, and the rotatable frame further includes a supplementary detergent tank for exposing the supplementary detergent introduction portion, selectively.

And, preferably, the liquid detergent portion includes a cap for introducing the liquid detergent, and the liquid detergent portion has a top portion formed to have a recessed portion recessed as much as a height of the cap.

And, preferably, the liquid detergent portion further includes a valve provided to a bottom thereof for discharging the liquid detergent introduced thereto by siphon.

And, preferably, the liquid detergent portion includes a fastening portion formed on an outside circumference thereof for placing the liquid detergent portion on the rotatable frame.

Advantageous Effects of Invention

The present invention can provide a washing machine in which a detergent dispenser in the related art washing machine is improved for a user to use the detergent dispenser easily and conveniently.

The present invention can provide a washing machine having a detergent dispenser which enables selective introduction of powder detergent or liquid detergent for washing.

The present invention can provide a washing machine having a detergent dispenser which enables convenient cleaning of the detergent dispenser for maintenance when the detergent dispenser is used for a long time period.

The present invention can provide a washing machine having a detergent dispenser which enables to deal with user's change of requirements for kinds of the detergent and fiber softener and a user to use conveniently.

BRIEF DESCRIPTION OF DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

BEST MODE FOR CARRYING OUT THE INVENTION

Reference will now be made in detail to the specific embodiments of the present invention, examples of which are illustrated in the accompanying drawings. Wherever possible, the same reference numbers will be used throughout the drawings to refer to the same or like parts.

In describing the present invention, names of elements are defined taking functions of the elements into account. Therefore, it is required that the names are not to be understood to limit a technical configuration of the present invention. And, the names of the elements defined thus may be called in other names in this field of art.

And, as described before, the present invention relates to a washing machine, and more particularly, to a detergent dispenser. A configuration of the washing machine excluding the detergent dispenser may be identical to a general washing machine, and a technical aspect of the present invention is not limited by the configuration. Accordingly, description of a general washing machine will be made briefly, and description of the detergent dispenser will be made in detail.

A washing machine in accordance with embodiments of the present invention will be described with reference to FIGS. 2 and 3, in detail.

Figure 1:
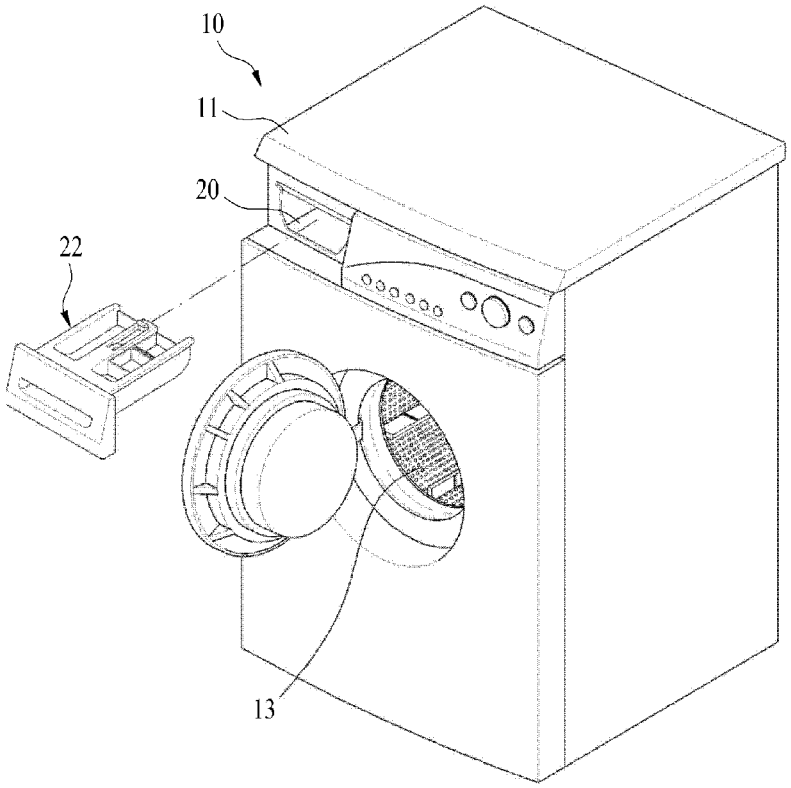
FIG. 1 illustrates a perspective view of a related art washing machine and a related art detergent dispenser.
Figure 2:
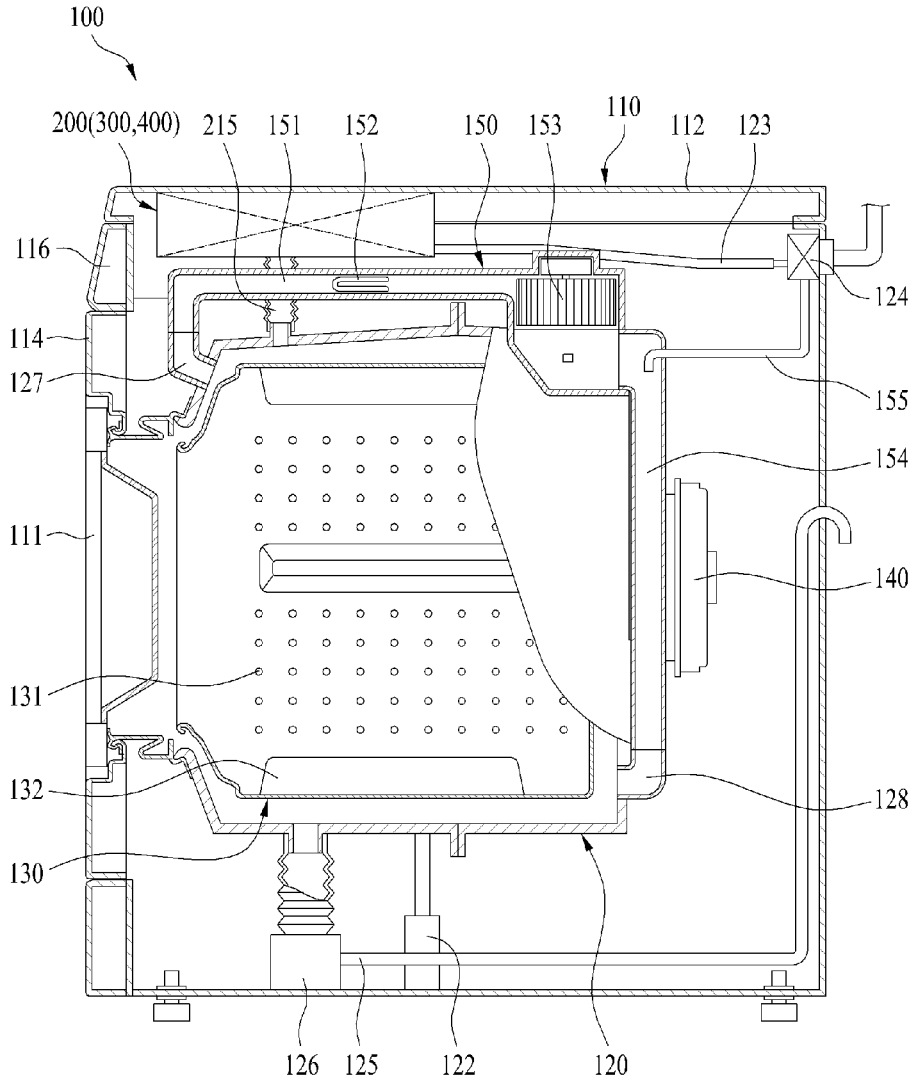
FIG. 2 illustrates a section of a washing machine in accordance with a preferred embodiment of the present invention, schematically.
Figure 3:
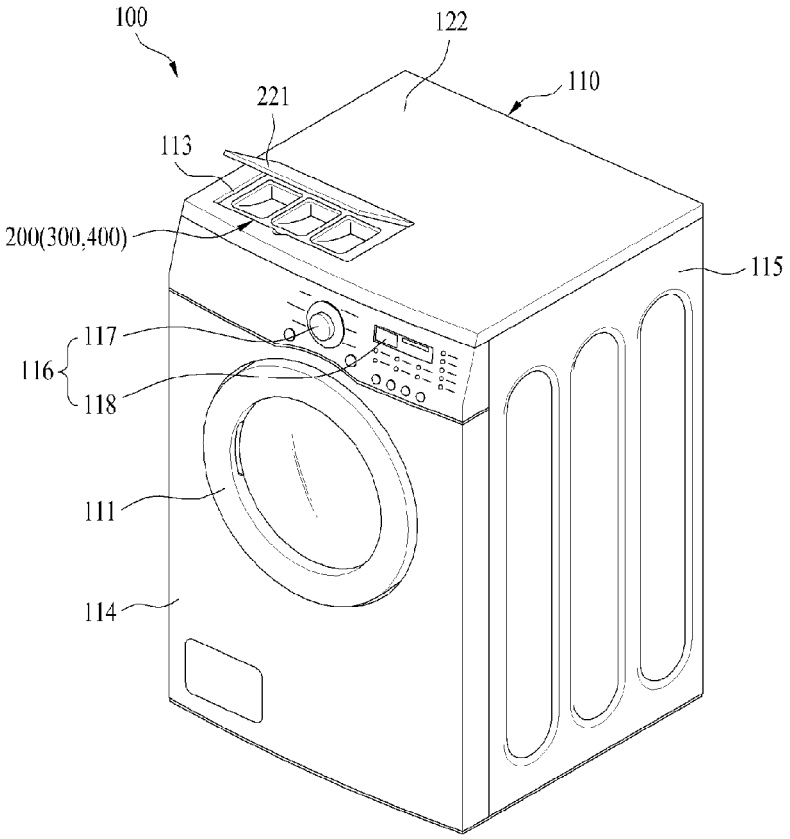
FIG. 3 illustrates a perspective view of an upper portion and a detergent dispenser of a washing machine in accordance with a preferred embodiment of the present invention.

FIG. 2 illustrates a section of a washing machine in accordance with a preferred embodiment of the present invention schematically, and FIG. 3 illustrates a perspective view of an upper portion and a detergent dispenser of a washing machine in accordance with a preferred embodiment of the present invention.

Referring to FIGS. 2 and 3, the washing machine includes a cabinet 110 having an upper plate 112, a front cover 114, side covers 115 and so on to form an exterior appearance of the washing machine, a tub 120 in the cabinet for holding washing water, a drum 130 rotatably mounted in the tub 120, a motor 140 for providing driving force to the drum 130, and springs (Not shown) and dampers 122 for supporting the tub 120 to be able to attenuate the same.

And, the washing machine also includes a door 111 mounted to a front of the cabinet 110 for opening and closing an inside of the washing machine, and a control panel 116 mounted to a top side of the front of the cabinet 110 for inputting a particular course which performs cycles of washing, drying or so on. The control panel 116 has an operation unit 117 for a user to select the cycles of washing, drying or so on, and a display unit 118 for displaying the cycle the user selected and an operation process of the washing machine 100.

Mounted to a top side of the cabinet 110, there is a detergent dispenser 200, 300, or 400. For this, the upper plate 112 has an opening for exposing the detergent dispenser 200, 300, or 400.

In the meantime, a plurality of embodiments of the detergent dispensers 200, 300, or 400 of the present invention will be described. Each of the detergent dispensers 200, 300, or 400 will be described in detail, after description of the washing machine 100.

In the meantime, provided over the tub 120, there are water supply means including a water supply hose 123 and a water supply valve 124 for supplying the washing water, and provided under the tub 120, there are water drain means including a drain hose 125 and a drain pump 126 for draining the washing water after finishing the washing.

And, the drum 130 is rotatably provided in the tub 120, and the laundry is introduced to an inside of the drum 130 through the door 111 to load the laundry therein. The drum 130 has a plurality of drain holes 131 formed therein for passing the washing water, and lefts 132 on an inside thereof for lifting and dropping the laundry loaded therein when the drum 130 rotates. Movement of the laundry owing to the lifts 132 may improve a washing performance.

And, the washing machine of the embodiment may have a drying unit 150 for performing a drying function. The drying unit includes a drying duct 151 for guiding hot air to an inside of the tub 120, and a condensing duct 154 for condensing moisture in the air being discharged from the tub 120, to remove the moisture from the air.

The drying duct 151 is connected to an air inlet 127 formed in a top side of a front of the tub 120 to guide the hot air to be introduced to the tub 120. And, the washing machine 100 also has a heater 152 for heating the air flowing an inside of the drying duct 151, and a fan 153 for providing power to the air to flow the inside of the drying duct 151.

And, the condensing duct 154 is connected to an air outlet 128 formed under a rear side of the tub 120 for introducing the air from the tub 120 to the condensing duct 154. And, there is a cooling water supply pipe 155 branched from one side of the water supply hose 123 for supplying cooling water to the condensing duct 154.

Operation of the washing machine 100 will be described, briefly. Washing and rinsing is performed as the washing water is introduced to the tub 120 through the water supply valve 124, and the washing water used thus is drained to an outside of the washing machine through the drain pump 126. And, as a water extraction cycle of the laundry is progressed after the washing and the rinsing, a washing course is finished.

Then, a drying cycle starts for drying the laundry having the water extracted therefrom thus. In the drying cycle, the heater 152 heats the air, and the fan 153 rotates to supply the air to the inside of the tub. The hot air supplied to the inside of the tub 120 removes moisture from the laundry, is discharged to an outside of the tub 120, and is introduced to the condensing duct 154. Cooling water is supplied from the cooling water supply pipe 155 to the condensing duct 154 for removing moisture from high temperature, high humidity air introduced to the condensing duct 154. Since the cooling water is cooler than the air in the condensing duct 154, the cooling water heat exchanges with the high temperature, and high humidity air passing through an inside of the condensing duct 154, to condense and remove the moisture from the air.

The detergent dispenser in accordance with a preferred embodiment of the present invention will be described with reference to the attached drawings, in detail.

Figure 4:
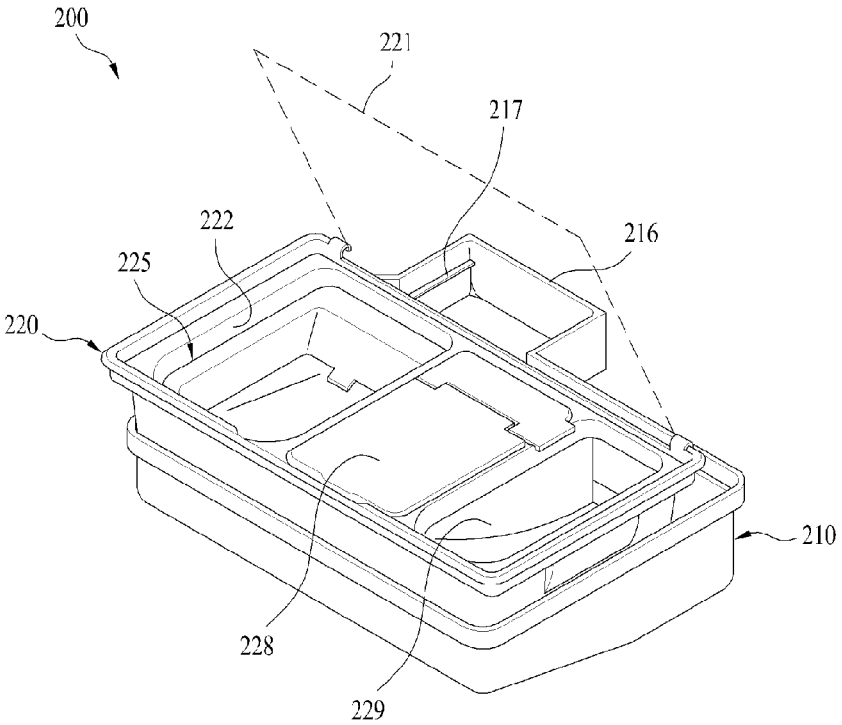
FIGS. 4 and 5 illustrate perspective views each showing a detergent dispenser in accordance with a preferred embodiment of the present invention, with a partial section.
Figure 5:
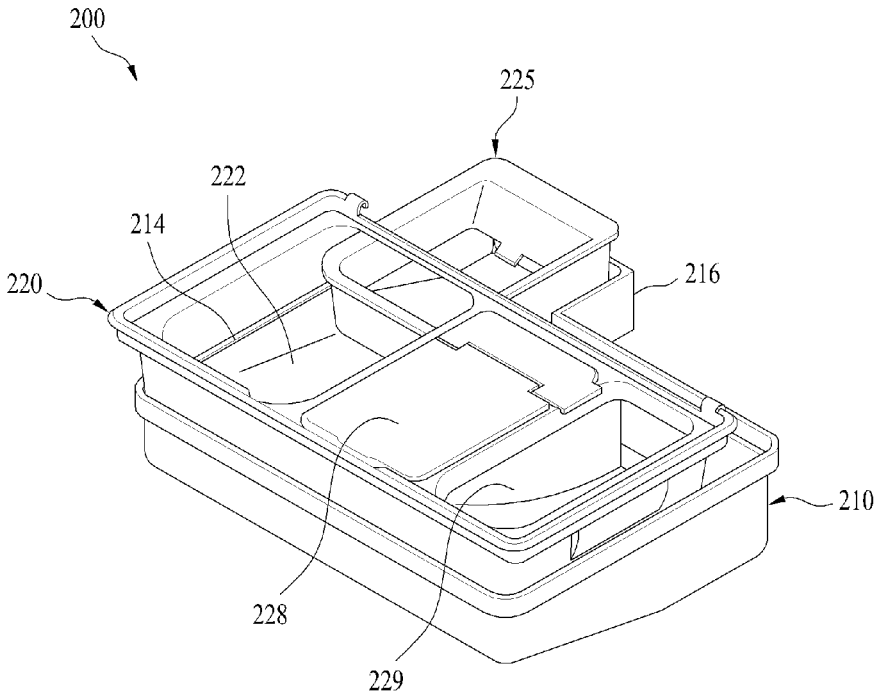
Figure 6:
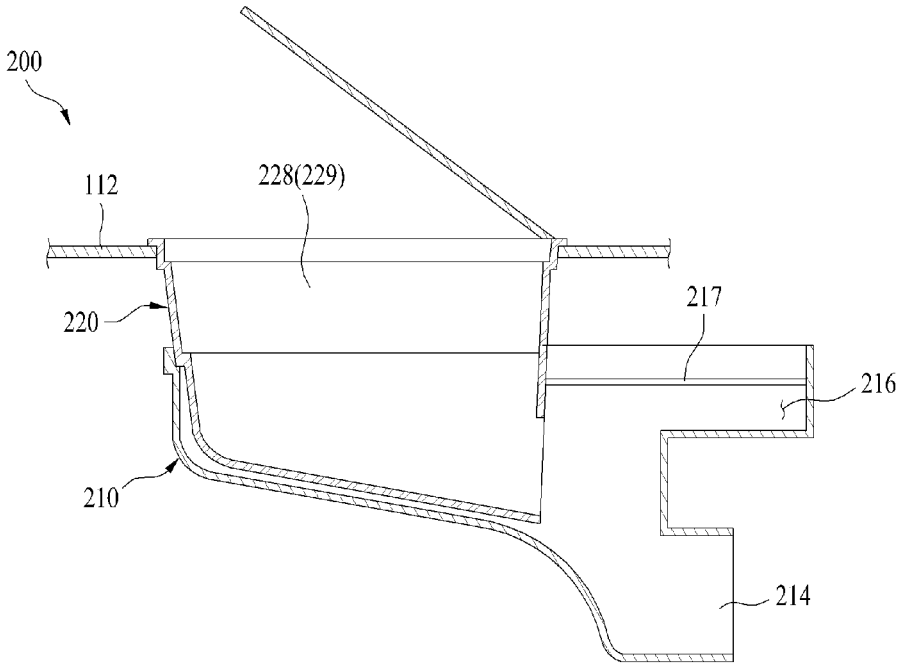
FIGS. 6 and 7 illustrate side views each showing a detergent dispenser in accordance with a preferred embodiment of the present invention.
Figure 7:
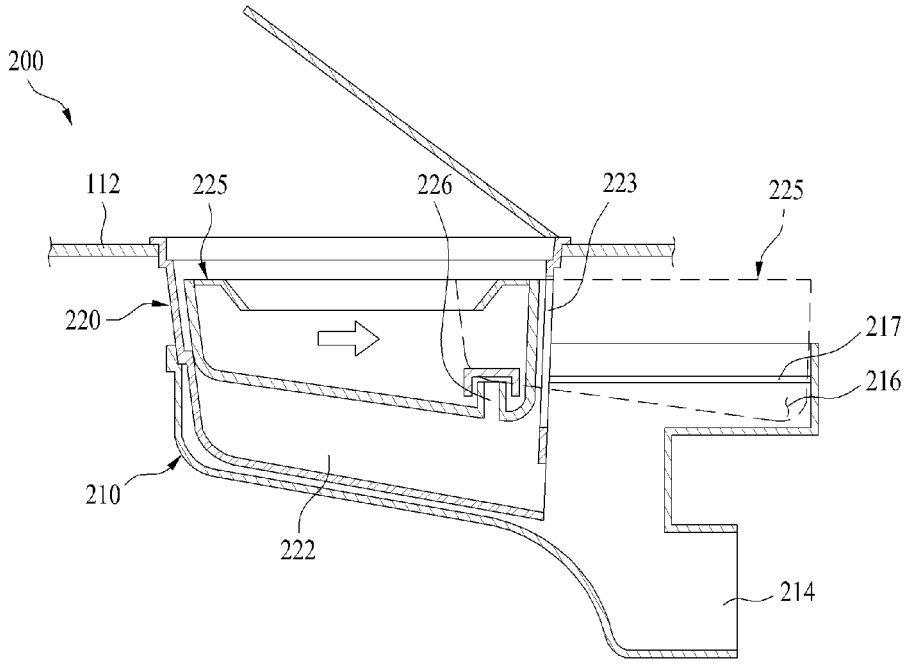

FIGS. 4 and 5 illustrate perspective views each showing a detergent dispenser in accordance with a preferred embodiment of the present invention, with partial section, and FIGS. 6 and 7 illustrate side views each showing a detergent dispenser in accordance with a preferred embodiment of the present invention.

Referring to FIGS. 4 and 5, the detergent dispenser 200 includes a dispenser housing 210 of a container shape mounted under the upper plate 112 of the cabinet 110 for forming a moving passage of liquid detergent, and dissolved powder detergent being supplied thereto, a detergent introduction tray 220 detachably seated on the dispenser housing 210 for introducing the liquid detergent, the powder detergent, fiber softener, and supplementary detergent thereto, and a liquid detergent drawer 225 slidably mounted to the detergent introduction tray 220 for enabling selective introduction of the liquid detergent or the powder detergent.

The dispenser housing 210 has a container shape with an opened upper side and a detergent supply hole 214 in one side of a rear thereof for supplying the liquid detergent, the powder detergent, the fiber softener, and the supplementary detergent to the tub 120. The detergent supply hole 214 is connected to the tub 120 with an additional bellows hose 215 (See FIG. 2).

And, the dispenser housing 210 has a dissolving water supply hose (Not shown) provided thereto additionally for supplying dissolving water to dissolve the powder detergent being supplied to the dispenser housing 210 and supplying the powder detergent dissolved thus to the tub 120. The dissolving water supply hose is a branch from the water supply hose 123 and may have a valve (Not shown) provided separately for supplying and controlling the dissolving water.

In the meantime, formed at a rear of the dispenser housing 210, there is a drawer space portion 216 for forming a space the liquid detergent drawer 225 of the detergent introduction tray 220 to be described later to move thereto. A configuration and a function of the drawer space portion 216 will be described after description of the detergent introduction tray 220, in detail.

The detergent introduction tray 220 is seated on an inside of an upper side of the dispenser housing 210. The detergent introduction tray 220 is detachably provided to the dispenser housing 210. According to this, if maintenance of the detergent dispenser 200, such as cleaning, or repair caused by defects of the detergent dispenser 200, is required, the dispenser housing 210 and the detergent introduction tray 220 may be cleaned or repaired after separating the dispenser housing 210 from the detergent introduction tray 220.

The detergent introduction tray 220 has a cover 221 hinge coupled to one side thereof for opening and closing the detergent introduction tray 220. Besides the hinge coupling, the cover 221 may be mounted to be slidable to an inside of the upper plate 112 for opening or closing the detergent introduction tray 220.

In the meantime, the detergent introduction tray 220 includes a powder detergent introduction portion 222 for introducing the powder detergent, a fiber softener introduction portion 228 for introducing the fiber softener, and a supplementary detergent introduction portion 229 for introducing the supplementary detergent. Respective introduction portions 222, 228, and 229 are recessed in the detergent introduction tray 220.

Each of the introduction portions 222, 228, and 229 is sloped such that a rear side thereof is lower than a front side thereof, and has a lowest side in communication with the dispenser housing 210. According to this, the powder detergent, the fiber softener, and the supplementary detergent introduced to each of the introduction portions 222, 228, and 229 is introduced to the dispenser housing 210, and therefrom to the tub 120 through the detergent supply hole 214 in the dispenser housing 210 (See FIGS. 6 and 7).

In the meantime, additionally provided to the powder detergent introduction portion 222 in the detergent introduction tray 220, there may be a dissolving water nozzle (Not shown) connected to the dissolving water supply hose of the dispenser housing 210. The dissolving water supplied through the dissolving water nozzle dissolves the powder detergent in the powder detergent introduction portion 222 to make the powder detergent to be introduced to the dispenser housing 210, smoothly. Since an existing detergent dispenser configuration can be utilized as such a dissolving water supply structure, description of detail of the structure will be omitted.

In the meantime, a liquid detergent drawer 225 is provided to the powder detergent introduction portion 222 in the detergent introduction tray 220 for introducing the liquid detergent. An outside shape of the liquid detergent drawer 225 has a container shape with an opened upper side formed in conformity with an inside shape of the powder detergent introduction portion 222. The liquid detergent drawer 225 has a bottom sloped downward from a front to a rear thereof for smooth flow of the liquid detergent introduced thereto. And, the liquid detergent drawer 225 has an introduction valve 226 at a rear thereof for discharging the liquid detergent introduced thereto to the detergent introduction tray 220. Since the introduction valve 226 is provided as a valve that utilizes siphon, and can utilize an existing detergent dispenser configuration, description of a detailed structure thereof will be omitted.

In the meantime, the liquid detergent drawer 225 is slidably provided in the powder detergent introduction portion 222. The liquid detergent drawer 225 is exposed from the powder detergent introduction portion 222 when it is intended to use the liquid detergent, enabling to use the liquid detergent, and is shifted to one side of the powder detergent introduction portion 222 to expose the powder detergent introduction portion 222 when it is intended to use the powder detergent, enabling to use the powder detergent.

To facilitate this, the powder detergent introduction portion 222 has an opening 223 formed in a rear thereof for moving and passing of the liquid detergent drawer 225 therethrough. And, the powder detergent introduction portion 222 has one pair of rails 224 on both sides of an inside thereof in a direction parallel to a moving direction of the liquid detergent drawer 225, and the liquid detergent drawer 225 has grooves (Not shown) on both sides of an outside thereof parallel to each other. According to this, as the grooves of the liquid detergent drawer 225 are respectively placed on the rails 224 of the powder detergent introduction portion 222, the liquid detergent drawer 225 is supported to be movable to an outside of the opening 223. According to this, the liquid detergent drawer may be shifted to expose the powder detergent introduction portion 222.

The dispenser housing 210 has a drawer space portion 216 formed additionally therein for securing a space for movement of the liquid detergent drawer 225. The drawer space portion 216 is formed as one unit with the dispenser housing 210 for preventing the liquid detergent leaked when the liquid detergent drawer 225 is moving from leaking to an outside of the dispenser housing 210. And, the drawer space portion 216 may have one pair of extended rails 217 on an inside thereof parallel to the rails 224 for guiding movement of the liquid detergent drawer 225, additionally.

The operation of the detergent dispenser in accordance with the preferred embodiment of the present invention will be described with reference to the attached drawings.

Figure 8:
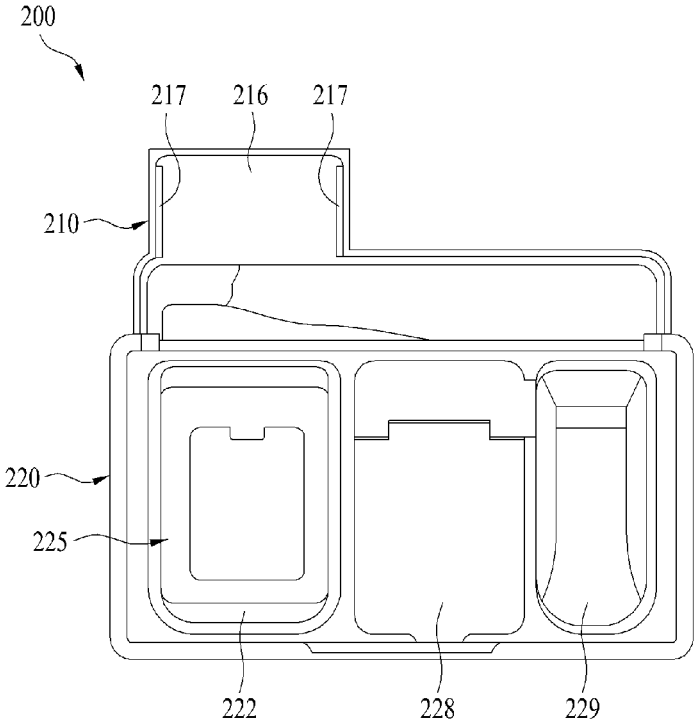
FIGS. 8 and 9 illustrate plan views each showing a detergent dispenser in accordance with a preferred embodiment of the present invention.
Figure 9:
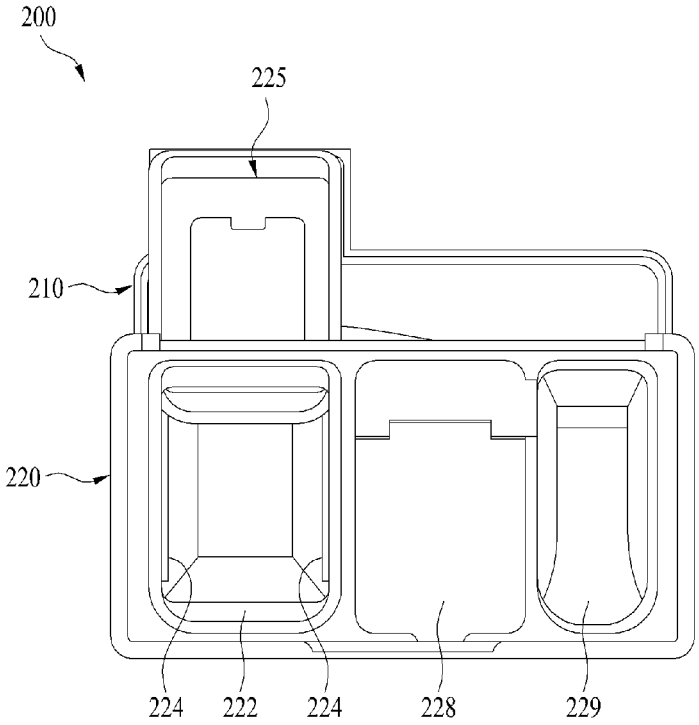

FIGS. 8 and 9 illustrate plan views each showing a detergent dispenser in accordance with a preferred embodiment of the present invention.

FIG. 8 illustrates a plan view showing a state of the detergent dispenser 200 when the liquid detergent is used. As shown, when the liquid detergent is used, the liquid detergent drawer 225 is positioned to be exposed from the powder detergent introduction portion 222. According to this, the user introduces the liquid detergent to the liquid detergent drawer 225, and the liquid detergent introduced to the liquid detergent drawer 225 thus flows down to the powder detergent introduction portion 222 in the detergent introduction tray 220 through the introduction valve 226 (See FIG. 7) formed in the liquid detergent drawer.

Then, the liquid detergent flowed down to the powder detergent introduction portion 222 thus flows down to the dispenser housing 210, again. Then, the liquid detergent flowed down to the dispenser housing 210 thus is supplied to the tub 120 through the detergent supply hole 214 in the dispenser housing 210.

The liquid detergent introduced to the liquid detergent drawer 225 flows down to the powder detergent introduction portion 222 by siphon, and then, discharged to the tub 120 from the detergent supply hole 214 in the dispenser housing 210 by gravity.

FIG. 9 illustrates a plan view showing a state of the detergent dispenser 200 when the powder detergent is used. As shown, when the powder detergent is used, the liquid detergent drawer 225 is slidably shifted from the powder detergent introduction portion 222 to expose the powder detergent introduction portion 222. In this instance, the liquid detergent drawer 225 moves along the rails 224 on the powder detergent introduction portion 222 to the drawer space portion 216 of the dispenser housing 210, thereby exposing the powder detergent introduction portion 222.

Then, the user introduces the powder detergent to the powder detergent introduction portion 222, and the powder detergent introduced thus is dissolved in the powder detergent introduction portion 222 by the dissolving water supplied separately and flows down to the dispenser housing 210. The powder detergent flowed down to the dispenser housing 210 thus is supplied to the tub 120 through the detergent supply hole 214 in the dispenser housing 210.

In the meantime, the embodiment of the present invention suggests configuring the detergent dispenser such that the liquid detergent is made to be used when the liquid detergent drawer 225 slides to the powder detergent introduction portion 222 to covers the powder detergent introduction portion 222. However, it is also possible that the liquid detergent is made to be used when the liquid detergent drawer 225 slides to the fiber softener introduction portion 228 or the supplementary detergent introduction portion 229 to cover the fiber softener introduction portion 228 or the supplementary detergent introduction portion 229.

According to the detergent dispenser 200 described above, since the dispenser housing 210 is separable from the detergent introduction tray 220, the detergent introduction tray 220 may be separated from the dispenser housing 210, to enable cleaning and maintenance and repair of the detergent dispenser 200 easier.

And, since the detergent introduction tray 220 has the powder detergent introduction portion 222 and the liquid detergent drawer 225, the user can use desired detergent of the powder detergent or the liquid detergent selectively, and, since the liquid detergent drawer 225 is provided to expose or cover the powder detergent introduction portion 222 selectively, the powder detergent and the liquid detergent can be used within a small space, selectively.

A detergent dispenser in accordance with another embodiment of the present invention will be described with reference to the attached drawings, in detail.

Figure 10:
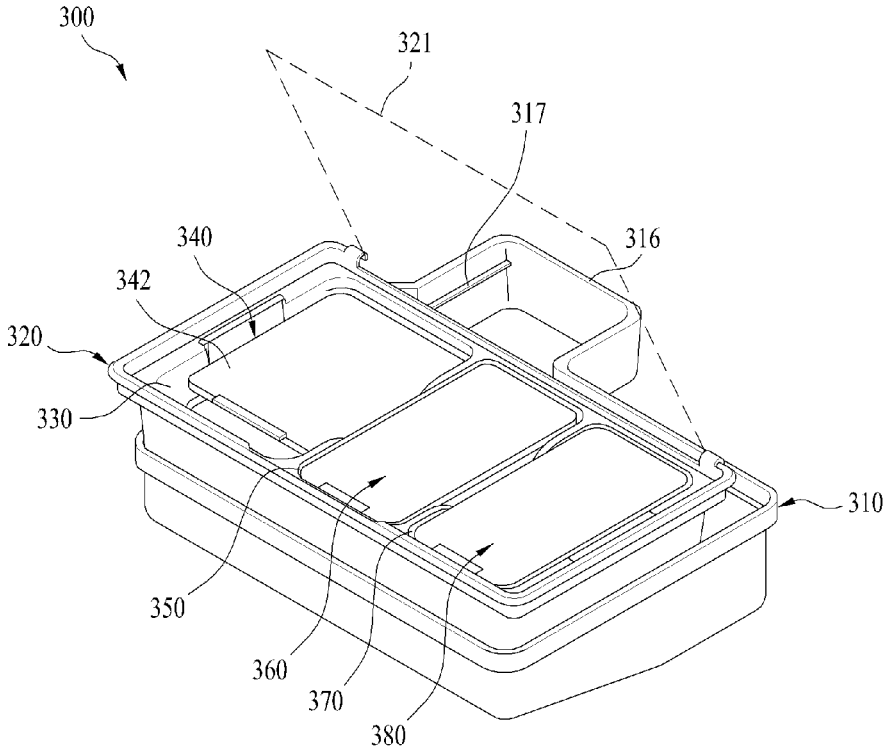
FIGS. 10 and 11 illustrate perspective views each showing a detergent dispenser in accordance with another preferred embodiment of the present invention, with a partial section.
Figure 11:
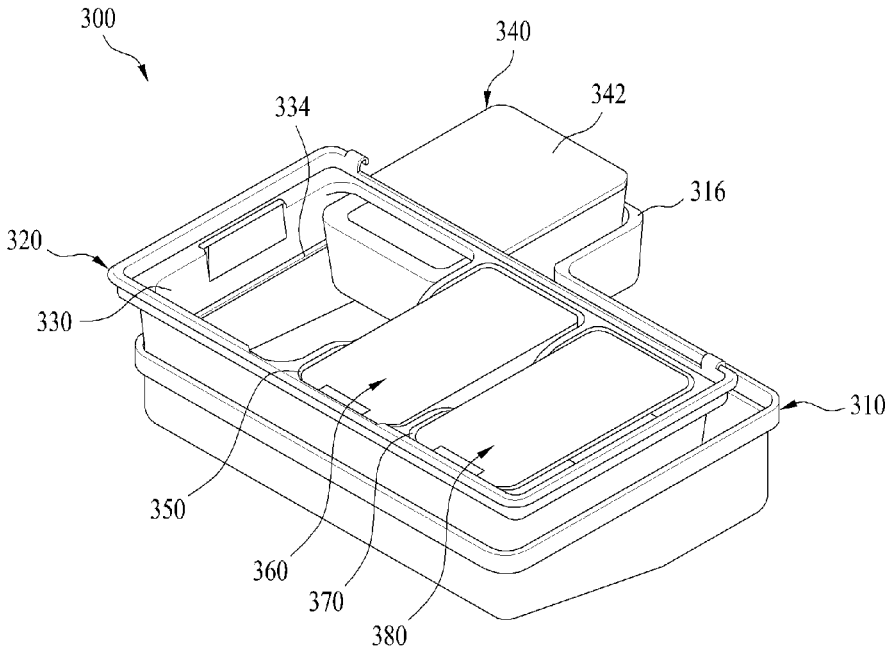
Figure 12:
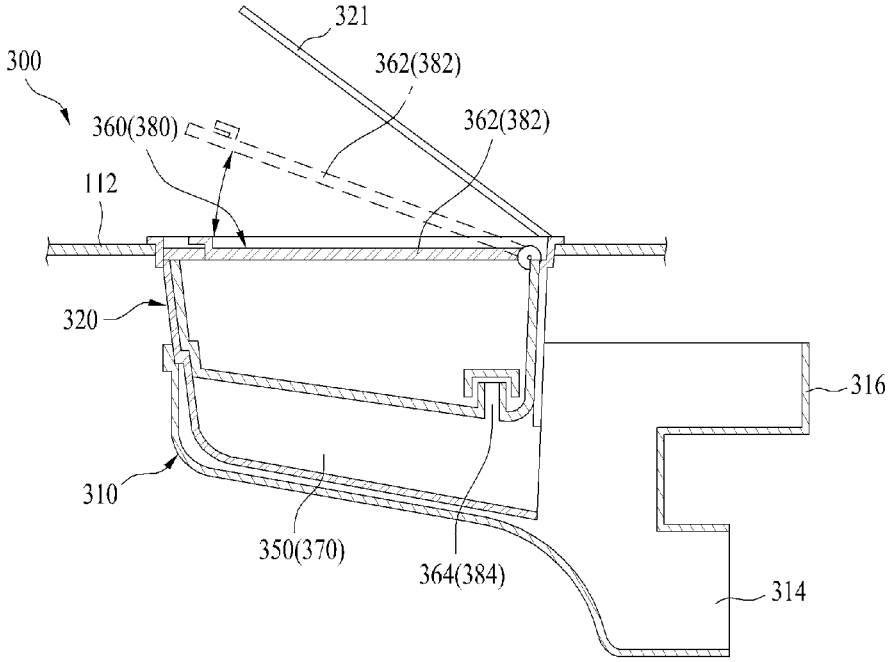
FIGS. 12 and 13 illustrate side views each showing a detergent dispenser in accordance with another preferred embodiment of the present invention.
Figure 13:
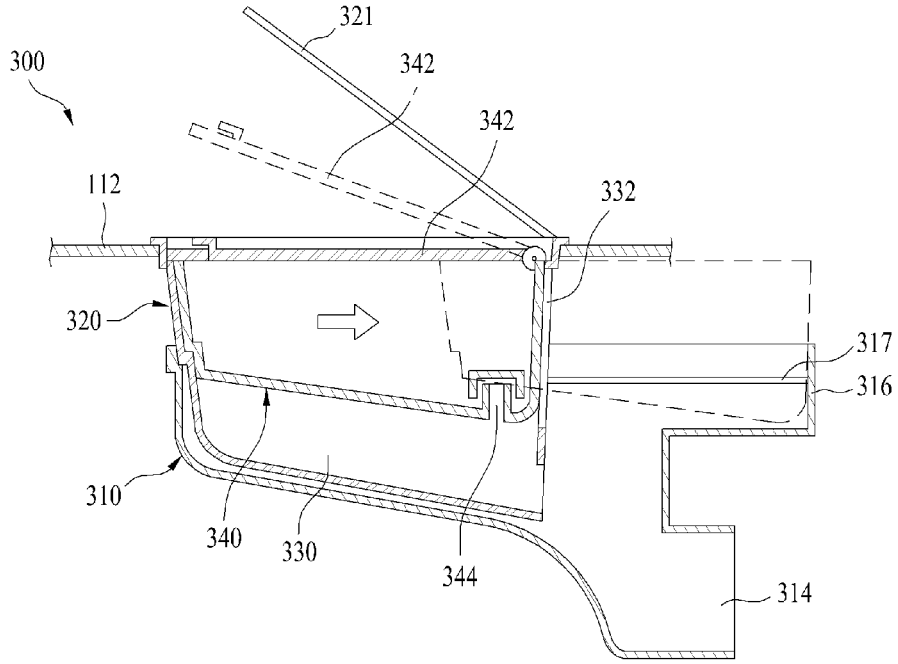

FIGS. 10 and 11 illustrate perspective views each showing a detergent dispenser in accordance with another preferred embodiment of the present invention, with a partial section, and FIGS. 12 and 13 illustrate side views each showing a detergent dispenser in accordance with another preferred embodiment of the present invention.

Referring to FIGS. 10 to 13, the detergent dispenser 300 includes a dispenser housing 310 of a container shape mounted under the upper plate 112 of the cabinet 110 to form a path of movement of liquid detergent and dissolved powder detergent, a detergent introduction tray 320 detachably seated on the dispenser housing 310 for introducing the liquid detergent, the powder detergent, fiber softener, and supplementary detergent thereto, and a liquid detergent tank 340 slidably mounted to the detergent introduction tray 320 for introducing the liquid detergent.

The dispenser housing 310 has a container shape with an opened upper side and a detergent supply hole 314 in one side of a rear thereof for supplying the liquid detergent, the powder detergent, the fiber softener, and the supplementary detergent to the tub 120. The detergent supply hole 314 is connected to the tub 120 with an additional bellows hose 315 (See FIG. 2).

And, the dispenser housing 310 has a dissolving water supply hose (Not shown) provided thereto additionally for supplying dissolving water to dissolve the powder detergent being supplied to the dispenser housing 310 and supplying the powder detergent dissolved thus to the tub 120. The dissolving water supply hose is a branch from the water supply hose 123 and may have a valve (Not shown) provided separately for supplying and controlling the dissolving water.

In the meantime, formed at a rear of the dispenser housing 310, there is a tank space portion 316 for forming a space the liquid detergent tank 340 of the detergent introduction tray 320 to be described later to move therein. A configuration and a function of the tank space portion 316 will be described after description of the detergent introduction tray 320, in detail.

The detergent introduction tray 320 is seated on an inside of an upper side of the dispenser housing 310. The detergent introduction tray 320 is detachably provided to the dispenser housing 310. According to this, if maintenance of the detergent dispenser 300, such as cleaning, or repair caused by defects of the detergent dispenser 300, is required, the dispenser housing 310 and the detergent introduction tray 320 may be cleaned or repaired after separating the dispenser housing 310 and the detergent introduction tray 320.

The detergent introduction tray 320 has a cover 321 hinge coupled to one side thereof for opening and closing the detergent introduction tray 320. Besides the hinge coupling, the cover 321 may be mounted to be slidable to an inside of the upper plate 112 for opening or closing the detergent introduction tray 320.

In the meantime, the detergent introduction tray 320 includes a powder detergent introduction portion 330 for introducing the powder detergent, a fiber softener introduction portion 350 for introducing the fiber softener, and a supplementary detergent introduction portion 370 for introducing the supplementary detergent. Respective introduction portions 330, 350, and 370 are recessed in the detergent introduction tray 320.

Each of the introduction portions 330, 350, and 370 is sloped such that a rear side is lower than a front side, and has a lowest side in communication with the dispenser housing 310. According to this, the powder detergent, the fiber softener, and the supplementary detergent introduced to respective introduction portions 330, 350, and 370 are introduced to the dispenser housing 310, and therefrom to the tub 120 through the detergent supply hole 314 in the dispenser housing 310 (See FIGS. 12 and 13).

In the meantime, provided to the powder detergent introduction portion 330 in the detergent introduction tray 320 additionally, there may be a dissolving water nozzle (Not shown) connected to the dissolving water supply hose of the dispenser housing 310. The dissolving water supplied through the dissolving water nozzle dissolves the powder detergent in the powder detergent introduction portion 330 to make the powder detergent to be introduced to the dispenser housing 310, smoothly. Since an existing detergent dispenser configuration can be utilized as such a dissolving water supply structure, description of detail of the structure will be omitted.

In the meantime, a liquid detergent tank 340 is provided to the powder detergent introduction portion 330 in the detergent introduction tray 320 for introducing the liquid detergent. An outside shape of the liquid detergent tank 340 has a container shape in conformity with an inside shape of the powder detergent introduction portion 330 with an opened upper side and a cover 342 provided separately for enclosing the liquid detergent tank 340. Or, alternatively, the liquid detergent tank 340 may be formed in an enclosed container shape with a separate cap (Not shown) provided to a top of the liquid detergent tank 340 for introducing the liquid detergent thereto.

And, the liquid detergent tank 340 has a bottom sloped downward from a front to a rear thereof for smooth flow of the liquid detergent introduced thereto. And, the liquid detergent tank 340 has a valve 344 at a rear of the bottom for discharging the liquid detergent introduced thereto to the detergent introduction tray 320. Since the valve 226 can utilize an existing detergent dispenser configuration, description of a detailed structure thereof will be omitted.

In the meantime, the liquid detergent tank 340 is slidably provided on an inside of the powder detergent introduction portion 330. The liquid detergent tank 340 is exposed from the powder detergent introduction portion 330 when it is intended to use the liquid detergent, enabling to fill the liquid detergent therein, and is shifted to one side of the powder detergent introduction portion 330 to expose the powder detergent introduction portion 330 when it is intended to use the powder detergent, enabling to use the powder detergent.

To facilitate this, the powder detergent introduction portion 330 has an opening 332 formed in a rear thereof for moving and passing of the liquid detergent tank 340 therethrough. And, the powder detergent introduction portion 330 has one pair of rails 334 on both sides of an inside thereof in a direction parallel to a moving direction of the liquid detergent tank 340, and the liquid detergent tank 340 has grooves (Not shown) on both sides of an outside thereof parallel to each other. According to this, as the grooves of the liquid detergent tank 340 are respectively placed on the rails 334 of the powder detergent introduction portion 330, the liquid detergent tank 340 is supported to be movable to an outside of the opening 332. According to this, the liquid detergent drawer may be shifted to expose the powder detergent introduction portion 330.

The dispenser housing 310 has a tank space portion 316 formed additionally therein for securing a space for shifting the liquid detergent tank 340 thereto. The tank space portion 316 is formed as one unit with the dispenser housing 310 for preventing the liquid detergent leaked when the liquid detergent tank 340 is moving from leaking to an outside of the dispenser housing 310. And, the tank space portion 316 may have one pair of extended rails 217 on an inside thereof parallel to the rails 334 for guiding movement of the liquid detergent tank 340, additionally.

In the meantime, the fiber softener introduction portion 350 for introducing the fiber softener, and the supplementary detergent introduction portion 370 for introducing the supplementary detergent may have a fiber softener tank 360, and a supplementary detergent tank 380 provided thereto, respectively.

In this instance, an outside shape of the fiber softener tank 360 has a container shape in conformity with an inside shape of the fiber softener introduction portion 350 with an opened upper side and a cover 362 provided separately for enclosing the fiber softener tank 360. Or, alternatively, the fiber softener tank 360 may be formed in an enclosed container shape with a separate cap (Not shown) provided to a top of the fiber softener tank 360 for introducing the fiber softener thereto.

And, the fiber softener tank 360 has a bottom sloped downward from a front to a rear thereof for smooth flow of the fiber softener introduced thereto. And, the fiber softener tank 360 has a valve 364 at a rear of the bottom for discharging the fiber softener introduced thereto to the fiber softener introduction portion 350. Since the valve 364 can utilize an existing detergent dispenser configuration, description of a detailed structure thereof will be omitted.

In the meantime, the fiber softener tank 360 is provided to be separable to an upper side of the fiber softener introduction portion 350. According to this, the user may fill the fiber softener in the fiber softener tank 360, or introduce the fiber softener to the fiber softener introduction portion 350, directly.

And, an outside shape of the supplementary detergent tank 380 has a container shape in conformity with an inside shape of the supplementary detergent introduction portion 370 with an opened upper side and a cover 382 provided separately for enclosing the supplementary detergent tank 380. Or, alternatively, the supplementary detergent tank 380 may be formed in an enclosed container shape with a separate cap (Not shown) provided to a top of the supplementary detergent tank 380 for introducing the supplementary detergent thereto.

And, the supplementary detergent tank 380 has a bottom sloped downward from a front to a rear thereof for smooth flow of the supplementary detergent introduced thereto. And, the supplementary detergent tank 380 has a valve 384 at a rear of the bottom for discharging the supplementary detergent introduced thereto to the supplementary detergent introduction portion 370. In this instance, since the valve 384 can utilize an existing detergent dispenser configuration, description of a detailed structure thereof will be omitted.

In the meantime, the supplementary detergent tank 380 is provided to be separable to an upper side of the supplementary detergent introduction portion 370. According to this, the user may fill the supplementary detergent in the supplementary detergent tank 380, or introduce the supplementary detergent to the supplementary detergent introduction portion 370, directly.

The operation of the foregoing detergent dispenser in accordance with another embodiment of the present invention will be described, with reference to the attached drawings, in detail.

Figure 14:
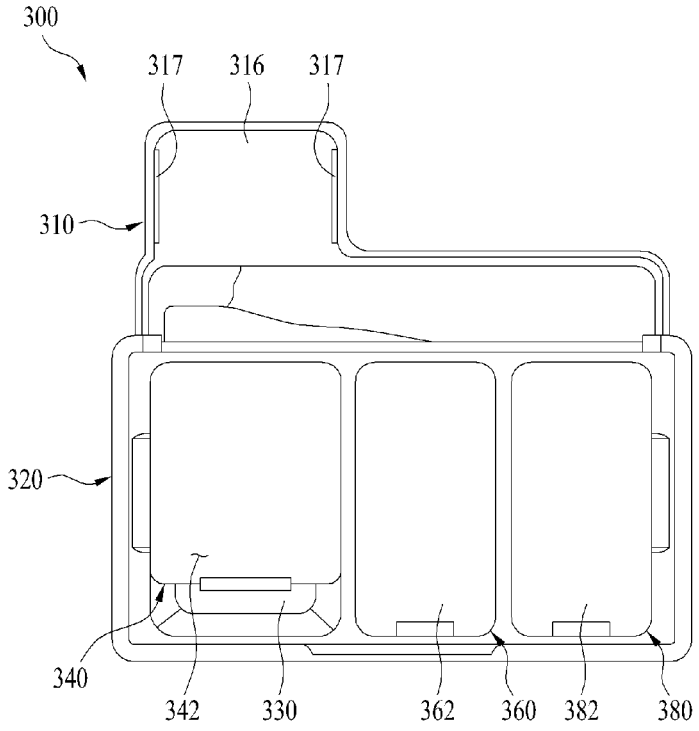
FIGS. 14 and 15 illustrate plan views each showing a detergent dispenser in accordance with another preferred embodiment of the present invention.
Figure 15:
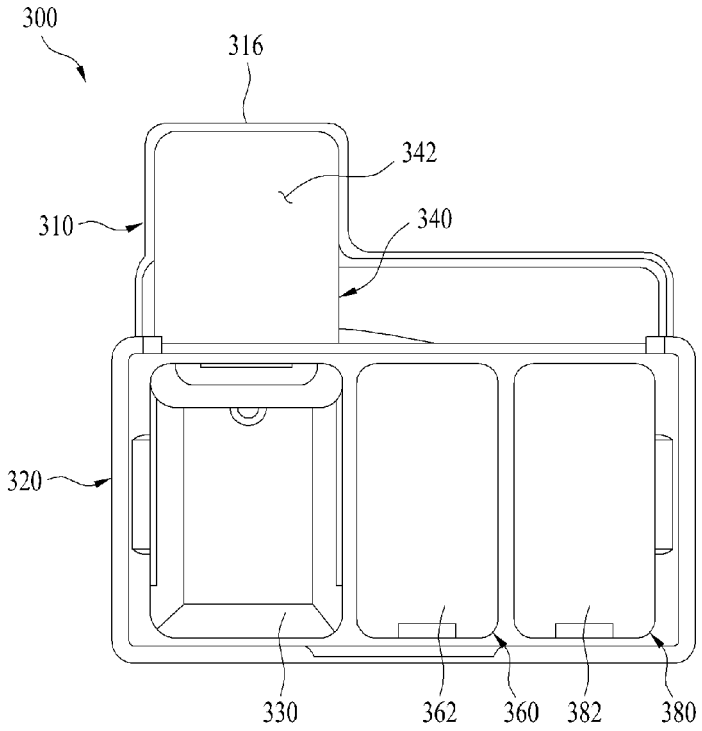

FIGS. 14 and 15 illustrate plan views each showing a detergent dispenser in accordance with another preferred embodiment of the present invention.

FIG. 14 illustrates a state of the detergent dispenser 300 when the liquid detergent is used. As shown, when the liquid detergent is introduced, the liquid detergent tank 340 is positioned at the powder detergent introduction portion 330 exposed therefrom. According to this, the user fills the liquid detergent in the liquid detergent tank 340, and the liquid detergent filled in the liquid detergent tank 340 thus flows down to the powder detergent introduction portion 330 through the valve 344 (See FIG. 13) formed on the liquid detergent tank 340.

Then, the liquid detergent flowed down to the powder detergent introduction portion 330 flows down to the dispenser housing 310, again. Then, the liquid detergent flowed down to the dispenser housing 310 is supplied to the tub 120 through the detergent supply hole 314 in the dispenser housing 310.

FIG. 15 illustrates a state of the detergent dispenser 300 when the powder detergent is used. As shown, when the powder detergent is used, the liquid detergent tank 340 is slid from the powder detergent introduction portion 330 to expose the powder detergent introduction portion 330. The liquid detergent tank 340 is shifted to the tank space portion 316 of the dispenser housing 310 along the rails 334 formed at the powder detergent introduction portion 330 to expose the powder detergent introduction portion 330.

Then, the user introduces the powder detergent to the powder detergent introduction portion 330. The powder detergent introduced thus is dissolved by the dissolving water supplied separately, and flows down to the dispenser housing 310. Then, the powder detergent flowed down to the dispenser housing 310 is supplied to the tub 120 through the detergent supply hole 314 in the dispenser housing 310.

Thus, since the dispenser housing 310 and the detergent introduction tray 320 are provided to be separable, the detergent dispenser 300 enables easy cleaning, repair, and maintenance by separating the detergent introduction tray 320 from the dispenser housing 310, if cleaning, maintenance, or repair is required.

And, because the powder detergent introduction portion 330 and the liquid detergent tank 340 are provided to the detergent introduction tray 320, the user can use the powder detergent or the liquid detergent selectively as the user desires, and, because the liquid detergent tank 340 is provided to expose or cover the powder detergent introduction portion 330 selectively, the powder detergent and the liquid detergent can be used within a small space, selectively.

A detergent dispenser in accordance with another preferred embodiment of the will be described with reference to the attached drawings, in detail.

Figure 16:
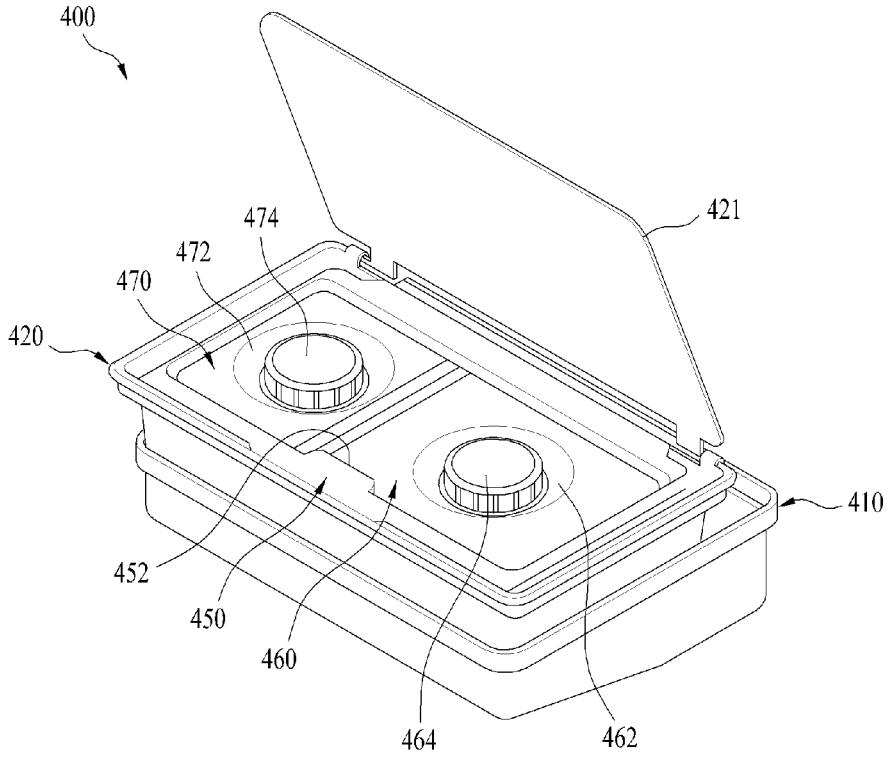
FIGS. 16 and 17 illustrate perspective views each showing a detergent dispenser in accordance with another preferred embodiment of the present invention, with a partial section.
Figure 17:
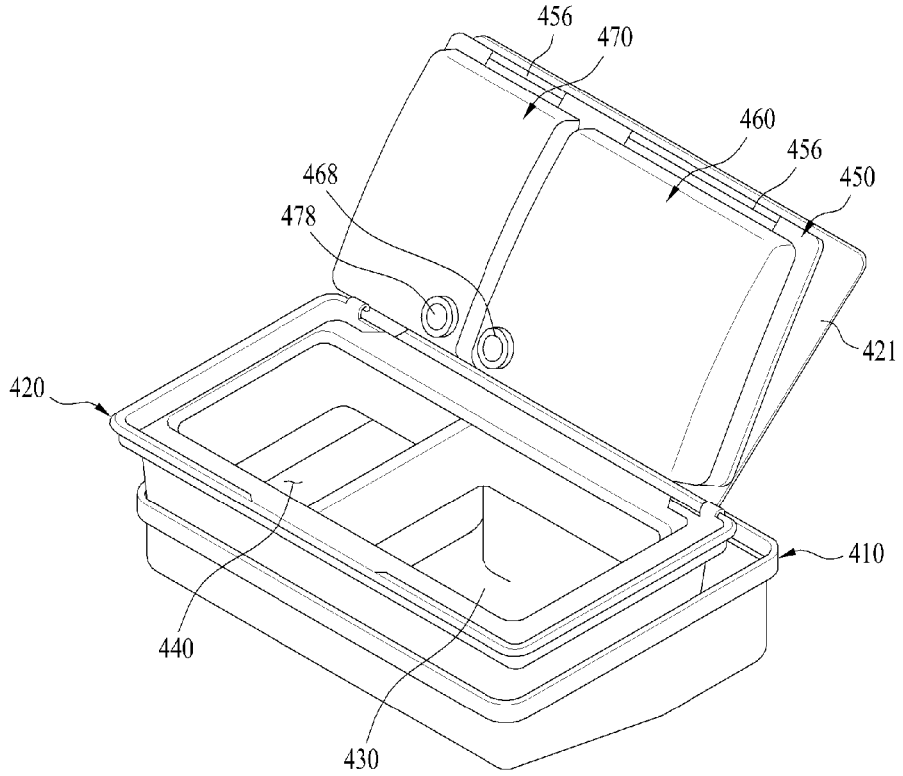
Figure 18:
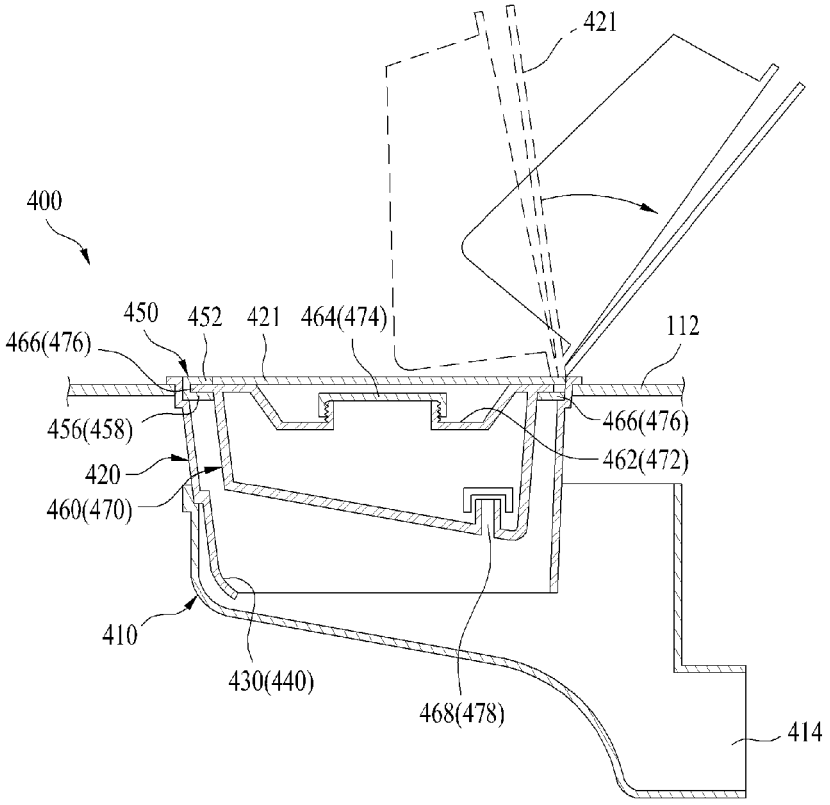
FIG. 18 illustrates a side view showing a detergent dispenser in accordance with another preferred embodiment of the present invention.

FIGS. 16 and 17 illustrate perspective views each showing a detergent dispenser in accordance with another preferred embodiment of the present invention, with a partial section, and FIG. 18 illustrates a side view showing a detergent dispenser in accordance with another preferred embodiment of the present invention.

Referring to FIGS. 16 and 17, the detergent dispenser 400 includes a dispenser housing 410 of a container shape mounted under the upper plate 112 of the cabinet 110 to form a path of movement of liquid detergent (Or, fiber softener, supplementary detergent, and so on) being supplied and dissolved powder detergent, a detergent introduction tray 420 detachably seated on the dispenser housing 410 for introducing the liquid detergent, the powder detergent, the fiber softener, and the supplementary detergent thereto, and a rotatable frame 450 rotatably provided to the detergent introduction tray 420 for fastening a liquid detergent tank 460 (Or, a fiber softener tank 470) for filling the liquid detergent (Or, the fiber softener) therein.

The dispenser housing 410 has a container shape with an opened upper side and a detergent supply hole 414 in one side of a rear thereof for supplying the liquid detergent, the powder detergent, the fiber softener, and the supplementary detergent to the tub 120. The detergent supply hole 414 is connected to the tub 120 with an additional bellows hose 415 (See FIG. 2).

And, the dispenser housing 410 has a dissolving water supply hose (Not shown) provided thereto additionally for supplying dissolving water to dissolve the powder detergent being supplied to the dispenser housing 410 and supplying the powder detergent dissolved thus to the tub 120. The dissolving water supply hose is a branch from the water supply hose 123 and may have a valve (Not shown) provided separately for supplying and controlling the dissolving water.

The detergent introduction tray 420 is seated on an inside of an upper side of the dispenser housing 410. The detergent introduction tray 420 is detachably provided to the dispenser housing 410. According to this, if maintenance of the detergent dispenser 400, such as cleaning, or repair caused by defects of the detergent dispenser 400, is required, the dispenser housing 410 and the detergent introduction tray 420 may be cleaned or repaired after separating the dispenser housing 410 from the detergent introduction tray 420.

The detergent introduction tray 420 has a cover 421 hinge coupled to one side thereof for opening or closing the detergent introduction tray 420. Besides the hinge coupling, the cover 421 may be mounted to be slidable to an inside of the upper plate 112 for opening or closing the detergent introduction tray 420.

In the meantime, the detergent introduction tray 420 has a powder detergent introduction portion 430 for introducing the powder detergent, a fiber softener introduction portion 440 for introducing the fiber softener, and a supplementary detergent introduction portion 445 for introducing the supplementary detergent. Respective introduction portions 430, 440, and 445 are recessed in the detergent introduction tray 420.

Each of the introduction portions 430, 440, and 445 is sloped such that a rear side is lower than a front side, and has a lowest side in communication with the dispenser housing 410. According to this, the powder detergent, the fiber softener, and the supplementary detergent introduced to each of the introduction portions 430, 440, and 445 is introduced to the dispenser housing 410, and therefrom, to the tub 120 through the detergent supply hole 414 in the dispenser housing 410 (See FIG. 18).

And, provided to the powder detergent introduction portion 430 in the detergent introduction tray 420 additionally, there may be a dissolving water nozzle (Not shown) connected to the dissolving water supply hose of the dispenser housing 410. The dissolving water supplied through the dissolving water nozzle dissolves the powder detergent in the powder detergent introduction portion 430 to make the powder detergent to be introduced to the dispenser housing 410, smoothly. Since an existing detergent dispenser configuration can be utilized as such a dissolving water supply structure, description of detail of the structure will be omitted.

In the meantime, the rotatable frame 450 is provided between the detergent introduction tray 420 and the cover. The rotatable frame 450 has a shape in conformity with an inside circumference of an upper side of the detergent introduction tray 420 with a central space portion. The liquid detergent tank 460 and the fiber softener tank 470 are detachably mounted to the space portion of the rotatable frame 450 for supplying the liquid detergent and the fiber softener filled through the powder detergent introduction portion 430 and the fiber softener interlocution portion 400, respectively.

In this instance, the rotatable frame 450 has a handle formed on a front side thereof for rotating the rotatable frame, and a liquid detergent tank fastening portion 456 and a fiber softener tank fastening portion 458 provided to an inside thereof for fastening the liquid detergent tank 460 and the fiber softener tank 470 thereto, respectively. The liquid detergent tank fastening portion 456 and the fiber softener tank fastening portion 458 are provided to apply a pressure to the liquid detergent tank 460 and the fiber softener tank 470 supportably with a predetermined elastic force.

In the meantime, the liquid detergent tank 460 has an outside shape formed to have a container shape with a size smaller than an inside shape of the powder detergent introduction portion 430, with a cap 464 provided to a top thereof separately for introducing the liquid detergent thereto. The top of the liquid detergent tank 460 provided with the cap 464 has a recessed portion 462 recessed to an inside of the liquid detergent tank 460. The recessed portion 462 is formed to make a mounted position of the cap 464 low for preventing the cap 464 from interfering with the cover 421 when the cover 421 provided to the detergent introduction tray 420 is closed.

And, the liquid detergent tank 460 has an introduction valve 468 formed on a rear of a bottom thereof for discharging the liquid detergent being introducing thus to the detergent introduction tray 420. And, the liquid detergent tank 460 has the bottom sloped downward from a front to the rear thereof for smooth flow of the liquid detergent filled thus toward the introduction valve 468. Since an existing detergent dispenser configuration can be utilized, description of a detailed structure of the introduction valve 468 will be omitted.

In the meantime, the liquid detergent tank 460 has a fastening portion 466 on an outside circumference of the liquid detergent tank 460 for placing the liquid detergent tank 460 on the rotatable frame 450. In this instance, it is formed such that at least two sides of the outside circumference of the liquid detergent tank 460 are in contact with an inside of the rotatable frame 450, and the fastening portion 466 is an extension from the liquid detergent tank 460 at the side the liquid detergent tank 460 is in contact with the rotatable frame 450. According to this, the fastening portion 466 has one side placed on the rotatable frame 450, and the other side placed on the liquid detergent tank fastening portion 456 formed on the rotatable frame 450.

In the meantime, the fiber softener tank 470 has an outside shape formed to have a container shape with a size smaller than an inside shape of the powder detergent introduction portion 430, with a cap 474 provided to a top thereof separately for introducing the fiber softener thereto. In this instance, the top of the fiber softener tank 470 provided with the cap 474 has a recessed portion 472 recessed to an inside of the fiber softener tank 470. The recessed portion 472 is formed to make a mounted position of the cap 474 low for preventing the cap 474 from interfering with the cover 421 when the cover 421 provided to the detergent introduction tray 420 is closed.

And, the fiber softener tank 470 has an introduction valve 478 formed on a rear of a bottom thereof for discharging the fiber softener being introducing thus to the detergent introduction tray 420. And, the fiber softener tank 470 has the bottom sloped downward from the front to the rear thereof for smooth flow of the fiber softener filled thus toward the introduction valve 478. Since an existing detergent dispenser configuration can be utilized, description of a detailed structure of the introduction valve 468 will be omitted.

In the meantime, the fiber softener tank 470 has a fastening portion 476 on an outside circumference of the fiber softener tank 470 for placing the fiber softener tank 470 on the rotatable frame 450. In this instance, it is formed such that at least two sides of the outside circumference of the fiber softener tank 470 are in contact with an inside of the rotatable frame 450, and the fastening portion 476 is an extension from the fiber softener tank 470 on the side the fiber softener tank 470 is in contact with the rotatable frame 450. According to this, the fastening portion 476 has one side placed on the rotatable frame 450, and the other side placed on the fiber softener tank fastening portion 458 formed on the rotatable frame 450.

The operation of the foregoing detergent dispenser in accordance with another embodiment of the present invention will be described, with reference to the attached drawings, in detail.

Figure 19:
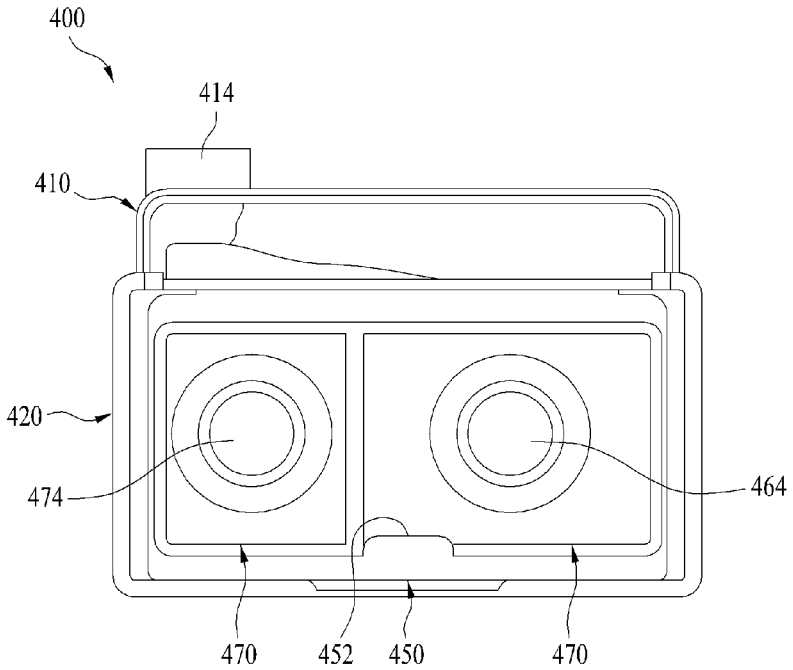
FIGS. 19 and 20 illustrate plan views each showing a detergent dispenser in accordance with another preferred embodiment of the present invention.
Figure 20:
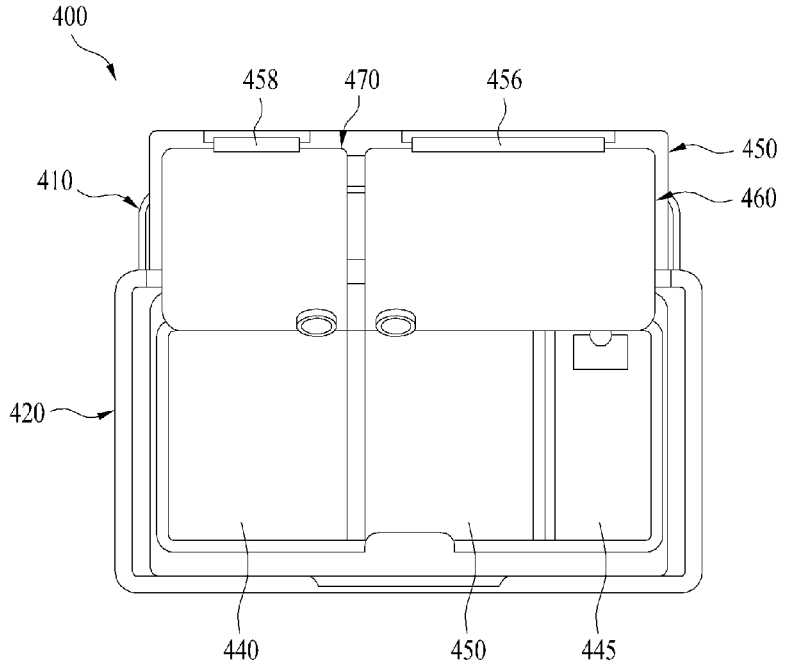

FIGS. 19 and 20 illustrate plan views each showing a detergent dispenser in accordance with another preferred embodiment of the present invention.

FIG. 19 illustrates a state of the detergent dispenser 300 when the liquid detergent is used. As shown, when the liquid detergent tank 460 or the fiber softener tank 470 is used, the rotatable frame 450 having the liquid detergent tank 460 and the fiber softener tank 470 fastened thereto is positioned in a state the rotatable frame 450 is rotated to a side of the detergent introduction tray. According to this, the user fills the liquid detergent or the fiber softener in the liquid detergent tank 460 or the fiber softener tank 470, and the liquid detergent or the fiber softener filled in the liquid detergent tank 460 or the fiber softener tank 470 thus flows down to the powder detergent introduction portion 420 through respective valves 466 or 478 (See FIG. 18).

Then, the liquid detergent or the fiber softener flowed down to the powder detergent introduction portion 430 thus flows down to the dispenser housing 410, again. Then, the liquid detergent or the fiber softener flowed down to the dispenser housing 310 thus is supplied to the tub 120 through the detergent supply hole 414 in the dispenser housing 410.

FIG. 20 illustrates a state of the detergent dispenser 400 when the powder detergent is used. As shown, when the powder detergent is used, the rotatable frame 450 having the liquid detergent tank 460 and the fiber softener tank 470 fastened thereto is rotated. According to this, as the rotatable frame is rotated, the powder detergent introduction portion 430, the fiber softener introduction portion 440, the supplementary detergent introduction portion 445, and so on which are formed at the detergent introduction tray are exposed.

Then, the user may introduce the powder detergent, the fiber softener, the supplementary detergent, and so on to the powder detergent introduction portion 430, the fiber softener introduction portion 440, and the supplementary detergent introduction portion 445, selectively. The powder detergent introduced thus is dissolved at the powder detergent introduction portion 430 by the dissolving water supplied separately, and flows down to the dispenser housing 410. Then, the powder detergent flowed down to the dispenser housing 410 is supplied to the tub 120 through the detergent supply hole 414 in the dispenser housing 410.

Thus, since the dispenser housing 410 and the detergent introduction tray 420 are separably provided, the detergent dispenser 400 enables easy cleaning, repair, and maintenance by separating the detergent introduction tray 420 from the dispenser housing 410, if cleaning, maintenance, or repair is required.

And, since the rotatable frame, which opens/closes the powder detergent introduction portion 430, the fiber softener introduction portion 440, and the supplementary detergent introduction portion 445, and fastens the liquid detergent tank 460 and the fiber softener tank 470 the liquid detergent and the fiber softener are respectively filled therein, is rotatably provided to the detergent introduction tray 420 having the powder detergent introduction portion 430, the fiber softener introduction portion 440, and the supplementary detergent introduction portion 445 formed thereon, the user can use the liquid detergent or the powder detergent, selectively.

Moreover, since the liquid detergent tank 460 and the fiber softener tank 470 are provided to overlap with the powder detergent introduction portion 430, the fiber softener introduction portion 440, and the supplementary detergent introduction portion 445, the powder detergent and the liquid detergent can be used within a small space, selectively.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A washing machine comprising:

a cabinet which forms an exterior appearance of the washing machine, the cabinet having an upper plate having an opening to exposes detergent dispenser;

a tub provided to the cabinet;

a drum rotatably provided to the tub; and the detergent dispenser provided in a lower side of the opening of the upper plate of the cabinet, the detergent dispenser having a powder detergent introduction portion for introduction of powder detergent, and a liquid detergent portion which enables selective supply of one of the powder detergent and the liquid detergent by exposing or covering the powder detergent introduction portion, wherein the detergent dispenser includes:

a dispenser housing secured to an inside of the cabinet to be in communication with the tub;

a detergent introduction tray having the powder detergent introduction portion formed therein, the detergent introduction tray detachably seated on the dispenser housing; and cover hinge coupled to one side of the detergent introduction tray to open and close the detergent introduction tray and provided within a portion of the upper plate so as to form a portion of an upper surface of the upper plate, wherein the liquid detergent tray slidably moves to/from the powder detergent introduction portion to expose/cover the powder detergent introduction portion, selectively, and wherein the dispenser housing further includes a space portion formed therein so as to provide a space the liquid detergent tray can move thereto when the liquid detergent tray slidably moves from the powder detergent introduction portion.

2. The washing machine as claimed in claim 1, wherein the detergent dispenser includes:

one pair of grooves extended to both sides of an outside of the liquid detergent tray parallel to a moving direction of the liquid detergent tray, and one pair of rails extended to both sides of an inside of the powder detergent introduction portion and the space portion to seat the grooves thereon, respectively.

3. The washing machine as claimed in claim 1, wherein the liquid detergent portion tray has a container shape with one opened upper side having a valve provided to a bottom thereof for discharging the liquid detergent introduced thereto by siphon.

4. The washing machine as claimed in claim 3, wherein the liquid detergent tray has a bottom sloped downward to the valve.

5. The washing machine as claimed in claim 1, wherein the detergent introduction tray further includes:

a fiber softener introduction portion for introduction of fiber softener, and a supplementary detergent introduction portion for introduction of supplementary detergent.

6. The washing machine as claimed in claim 5, wherein the fiber softener introduction portion further includes a fiber softener tank detachably or slidably seated thereon.

7. The washing machine as claimed in claim 5, wherein the supplementary detergent introduction portion further includes a supplementary detergent tank detachably or slidably seated thereon.

8. The washing machine as claimed in claim 1, wherein the liquid detergent tray rotates with respect to the powder detergent introduction portion to expose/cover the powder detergent introduction portion, selectively.

9. The washing machine as claimed in claim 8, further comprising a rotatable frame rotatably provided to the detergent introduction tray to mount and rotate the liquid detergent tray and to expose the powder detergent introduction portion, selectively.

10. The washing machine as claimed in claim 9, wherein the detergent introduction tray further includes a fiber softener introduction portion for introduction of the fiber softener, and the rotatable frame further includes a fiber softener tank to expose the fiber softener introduction portion, selectively.

11. The washing machine as claimed in claim 9, wherein the detergent introduction tray further includes a supplementary detergent introduction portion, and the rotatable frame further includes a supplementary detergent tank to expose the supplementary detergent introduction portion, selectively.

12. The washing machine as claimed in claim 9, wherein the liquid detergent tray includes a fastening portion formed on an outside circumference thereof to place the liquid detergent tray on the rotatable frame.

13. The washing machine as claimed in claim 8, wherein the liquid detergent tray includes a cap for introduction of the liquid detergent, and the liquid detergent tray has a top portion formed to have a recessed portion recessed as much as a height of the cap.

14. The washing machine as claimed in claim 13, wherein the liquid detergent tray further includes a valve provided to a bottom thereof to discharge, the liquid detergent introduced thereto by siphon.

15. The washing machine as claimed in claim 1, wherein the dispenser housing has a detergent supply hole connected to the tub, and the dispenser housing and the powder detergent introduction portion are sloped downward to the detergent supply hole.

16. The washing machine as claimed in claim 1, wherein the powder detergent introduction portion includes a water supplier to supply water to dissolve the powder detergent and improve fluidity of the powder detergent.

* * * * *